US005331869A

United States Patent [19]

Webb

[11] Patent Number: 5,331,869

[45] Date of Patent: Jul. 26, 1994

[54] ADJUSTABLE WRENCH HEAD AND HANDLE SYSTEM

[76] Inventor: Daniel S. Webb, 5909 S. Clayton, Littleton, Colo. 80121

[21] Appl. No.: 40,082

[22] Filed: Mar. 30, 1993

Related U.S. Application Data

[63] Continuation-in-part of Ser. No. 874,955, Apr. 15, 1992, abandoned.

[51] Int. Cl.[5] ..... B25B 23/16

[52] U.S. Cl. ..... 81/177.1; 81/177.2; 81/177.7; 81/489; 16/114 R; 403/326

[58] Field of Search ..... 16/114 R; 81/119, 124.3, 81/124.4, 124.7, 177.1, 177.2, 177.6, 177.7, 177.85, 489; 279/79; 403/287, 326, 361, 364, DIG. 1

[56] References Cited

U.S. PATENT DOCUMENTS

| | | | |
|---|---|---|---|
| 1,316,398 | 9/1919 | Steininger | 81/177.7 X |
| 1,431,389 | 10/1922 | Frisz | 81/177.7 |
| 2,147,163 | 2/1939 | Jimerson | 81/177.85 X |
| 2,697,642 | 12/1954 | Rudy | 403/DIG. 1 X |
| 2,964,981 | 12/1960 | Blunt | 81/177.2 |
| 2,978,938 | 4/1961 | Nalley | 81/177.7 X |
| 3,002,409 | 10/1961 | Jones | 81/177.2 |
| 4,794,829 | 1/1989 | Mesenhoeller | 81/177.8 |

FOREIGN PATENT DOCUMENTS

| | | | |
|---|---|---|---|
| 555340 | 6/1923 | France | 81/177.85 |
| 840339 | 1/1939 | France | 81/177.2 |
| 2545554 | 11/1984 | France | 81/177.85 |
| 42597 | 10/1972 | Japan | 81/177.85 |

*Primary Examiner*—James G. Smith
*Attorney, Agent, or Firm*—John P. Halvonik

[57] ABSTRACT

The invention is a novel wrench head attachment system comprising a plurality of various types of interfitting wrench heads and at least one wrench handle for connecting to the wrench heads. Wrench head types may be chosen from among those with open ends, hex ends, flair heads, ratcheting heads and crescent heads. Each of these types of heads would have a connection means for attaching to wrench handles chosen from among straight handles, angled handles, flexing handles, etc.

3 Claims, 2 Drawing Sheets

ADJUSTABLE WRENCH HEAD AND HANDLE SYSTEM

This is a continuation in part of Ser. No. 07/874,955 filed on Apr. 15, 1992, now abandoned.

FIELD OF INVENTION

1. Background of the Invention

The invention relates to the field of hand tools and, in particular, to a system of wrench handles and corresponding wrench heads of various types that have connecting means for attaching such wrench heads to the handles. The handles may also be of various types.

2. Description of the Prior Art

While there are detachable wrench heads that are known, none that applicant is aware of have a complete set of various shaped heads and handles that are completely interchangeable through various types of connecting means.

SUMMARY OF THE INVENTION

The invention is a system of interfitting wrench heads and handles through various connecting means. Connecting means are at one end of the handle and joining with a corresponding connecting means on the wrench head. This allows for choosing from among a plurality of wrench heads to meet the task at hand, and to chose from among a plurality of wrench handles to also meet different job requirements.

The heads may be chosen from among: ratcheting heads, open ended heads, closed heads, box heads, flair heads, and hex heads, The handles may be chosen from among straight handles and angled handles such as 90° and 45° handles. The connecting means that may be used include ball and detent, spring clip detent, cotter pin, magnetic detent, set screws, etc.

It is an object of the invention to provide a set of readily attachable wrench heads of various types which may be interchanged onto a wrench handle to meet various job requirements.

Another object of the invention is to provide a set of wrench handles of various types for interchanging along with a set of wrench heads so that wrench handles may be chosen for the various problem at hand.

Yet another objective is to provide set of wrench heads and handles for a plurality of purposes that are interchangeable to thereby save space requirements and to save on the cost of buying a separate set of wrenches for each type of job requirement.

Still another objective of the invention is to provide a set of joining means for wrench heads and handles so that combinations of handles and heads may be broken down and reassemble into various combinations.

Yet another objective is to provide a set of wrench heads with joining means to allow for multiple types of wrench heads to be adapted to a single handle.

Other objectives of the invention will become apparent to those skilled in the art once the the invention has been shown and described.

DESCRIPTION OF THE PREFERRED EMBODIMENT

Figure 1:
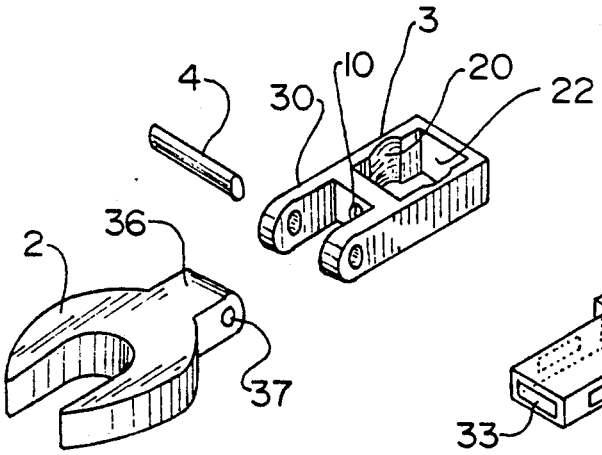
FIG. 1 Perspective view of adapter and wrench head.

Two important pieces to the invention are the handle 34 (with a square shank) and an adapter piece 3 that fits over the square shank. The head 2 may be constructed as a third piece which joins to the adapter by a pin 4. In this case, the wrench head/handle would be a three-part construction (the two parts shown in FIG. 1 plus the handle in FIG. 2).

The head 60 could also be constructed with a cavity 42 similar to the cavity 22. In that case it could join directly to the handle in FIG. 2 by means of the shank for a two part construction. Or, it could be attached to a modified piece 40 and this in turn connected to the adapter 3. In that case there would be a four part construction (the three parts shown in FIG. 7 plus the handle in FIG. 2).

The adapter piece 3 is connected to the handle 34 (FIG. 12) by means of a cavity 22 in the rear of this portion. This cavity has a pair of side walls with curved portions 20. A spring clip 32 in the handle 34 connects with the pair of curved portions 20 in the cavity 22.

Figure 6:
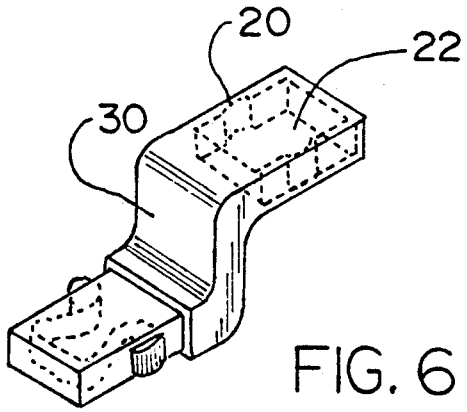
FIG. 6 View of double 90° connection.

The handle 34 has a front or shank portion of squared off construction. A hollow cavity lies inside the shank and contains a resilient metal clip 32. The clip projects out of the shank via windows 31 in shank. These windows are on sides opposite one another. Another window 33 is in the front of the shank and the spring clip may be inserted through it. The clip projects out of the windows in manner similar to that shown in FIG. 6. FIG. 6 shows a double 90° adapter portion but the spring clip and hollow cavity construction may be identical.

Figure 5:
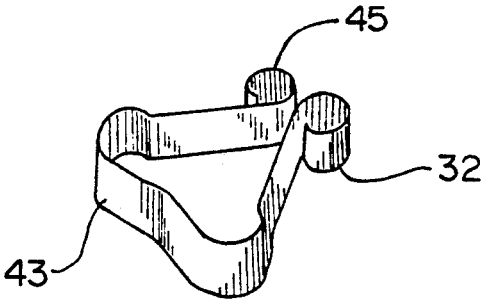
FIG. 5 Spring clip.
Figure 8:
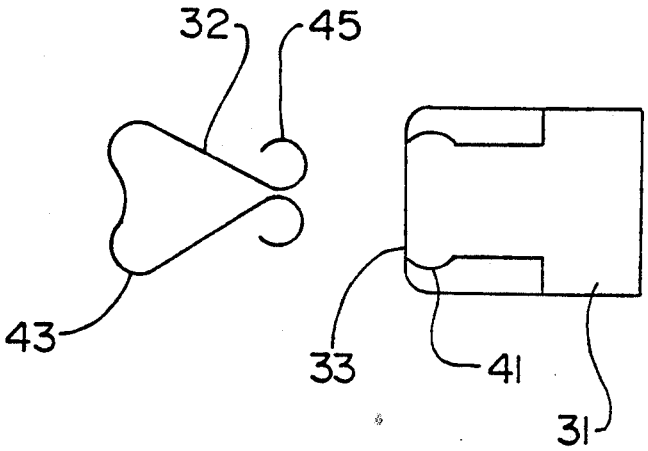
FIG. 8 Top view of spring clip and hollow portion.

The spring clip is constructed as shown in FIG. 5 and 8. Curved portions 45 near the back of the clip protrude out of the windows 31 and abut the curved portions 20 in the cavity 22. This results in a shank-cavity connection that is relatively sturdy and but the connection may be pulled apart by pulling back on the handle with exceptional force. Of course, the spring can be built with different strengths so that it will take greater or lesser force to remove the shank from the handle.

The spring is inserted by compressing it to form a configuration like that shown in FIG. 8 and inserted into the hollow. The spring may be removed from the hollow by inserting a small device such as a screwdriver into the window 33 which will compress the spring clip and the curved portions 45 will detach from the windows 31 and the spring will pop out of the hollow. Front portions 43 of the spring abut curved portions 41 in the walls of the hollow, see FIG. 8. This connection helps keep the spring in the hollow.

The wrench head piece 2 is connected to the front end of the adapter by means of a curved portion 36 (at the rear of the head) with an aperture 37 for the pin 4. The pin is fixed for rotational movement through apertures in the projecting portions 30 located at the front of the adapter portion. The head can pivot around the pin about 180°-200° to provide an adjustable wrench head that may be varied in relation to the handle.

Figure 3:
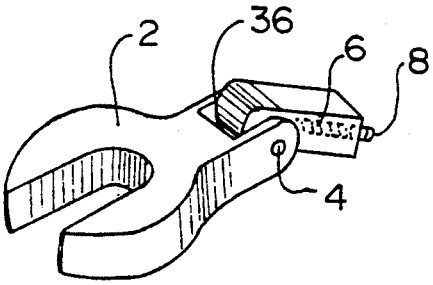
FIG. 3 Detail of pin/head connection.
Figure 4:
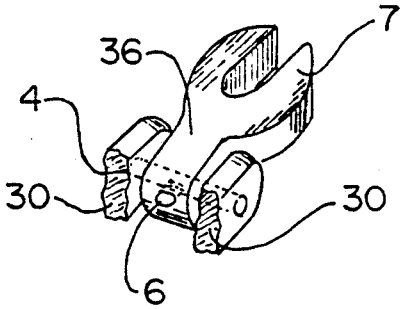
FIG. 4 Rear view of multi angle adjustment showing screw/pin connection. Cavity portion removed.

The head 2 may be adjusted to the desired angle with respect to the adapter (and of course the handle after the handle is attached to the adapter) and then secured into this position by means of the set screw 6, see FIG. 3. The head is secured from movement by this screw which tightens against the rounded portion 36 and prevents its movement. The set screw is accessed via the cavity 22.

Figure 7:
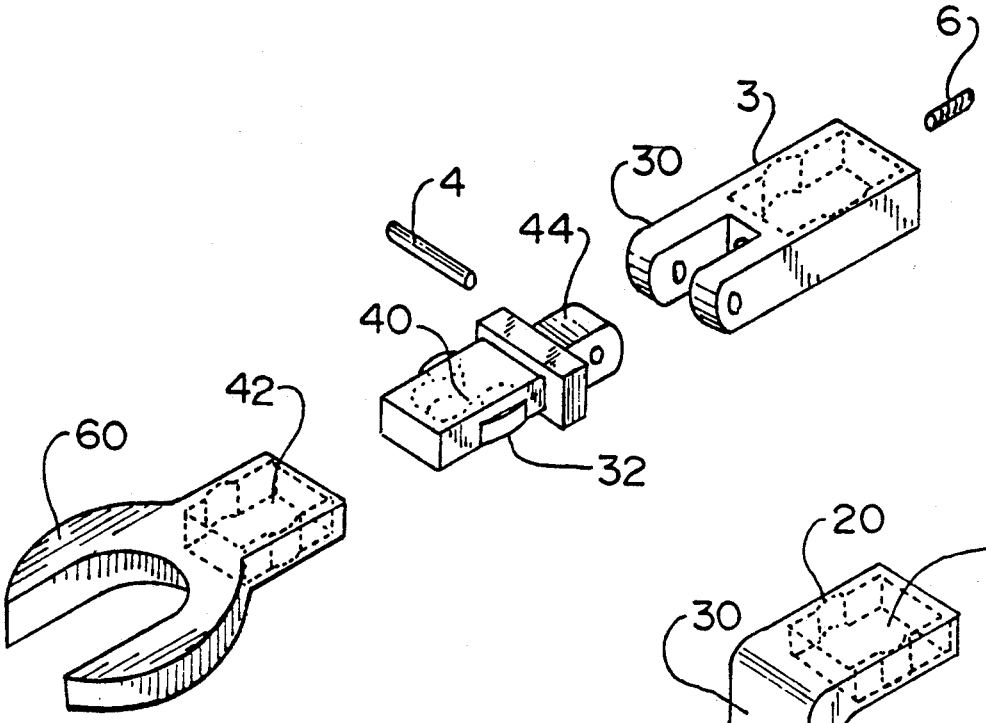
FIG. 7 Three part construction, head 60, special adapter 40 and adapter 3.

The set screw is in a threaded aperture 10 extending from the cavity to the front end as shown in FIG. 1 and 7. One end 7 of the screw fits against the rounded portion 36 at the rear of the head and prevents it from moving, see FIG. 3. This end of the screw may be rounded to conform to the rounded portion 36. The other end 8 extends into the cavity 22. The cavity provides access to the screw to thereby turn it.

The adapter piece may then be attached to the handle through curved portions 20 of the side walls of the cavity 22 (or 42) after the screw is set into place. In this manner, the head can be locked into position at various angles vis a vis the handle. The screw may be turned by means of an Allen wrench fits into a corresponding indented opening at the end of the screw. Other type screws may also be employed.

The double bend attachment 50 (double 90° piece) shown in FIG. 6 may also be used. This attachment would have a cavity 22 similar to that in the adapter piece and the other end having a spring clip 32 that protrudes through apertures in the sides of that end portion similar to the front of the handle. With this type of intermediate portion, the adapter may be attached to different heads with cavities via the spring clip 32. Thus, there could be a handle-double 90° piece-and head 60; a three part construction. Or, handle-double 90° piece-adapter 3-head 2; a four part construction. There could also be a five-part construction using the special piece 40.

An optional head adapter piece 40 is shown in FIG. 7. One end has a spring clip 32 and hollow body construction similar to those mentioned above and the other end has a rounded portion 44 with an aperture for connection with the pin 4. This piece allows various heads 60 of different shape and size to be adapted to the multi angle adjustment piece. These heads would have a cavity 42 with detents in the walls for connection with the spring clip 32. Various heads would have the cavity portion in common and thus heads of many different constructions can be attached to the wrench handle.

Figure 2:
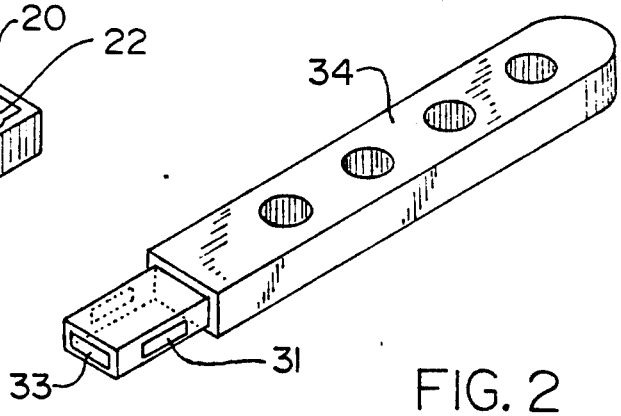
FIG. 2 Handle.

The handle is shown as FIG. 2. It has a spring clip portion 32 that fits inside a hollow cavity with windows 31 at each side. Portions of the spring clip protrude out of the windows. This allows the handle to be adapted to the cavity 22. This may be the cavity of the adapter piece 3 or may be the cavity of the double bent piece 50.

The spring is relatively "U" shaped with two extending legs 12 that have curved portions 13 at the ends, see FIG. 2. The base of the "U" also has curved portions 15 at each corner. The spring is inserted into the slot 7 by squeezing the legs and eventually the tips of the legs reach the open portions 9 and extend outward and the spring thus secures itself to the handle, see FIG. 3 and FIG. 1. The base of the spring secures itself to the curved walls near the front of the channel as the curved portions of the base fit into these curved portions. The handle is inserted into the opening 1 in the head and, as the outer portion of the tips of the legs project outward from the handle, these portions fit into the apertures 3 in the side walls of the opening and thus the handle is secured to the head, see FIG. 5–6.

Other types of attaching means include ball and detent systems, FIG. 10, cotter pin or split pin types FIG. 8, magnetic material detent, FIG. 9, and set screws with corresponding threaded apertures, FIG. 7. These are mentioned as examples but by no means do they exhaust the number of possibilities of attachment systems. Of course, it is contemplated that in each of these systems one of the pieces will be in connection with the non-working end of the head and the other, corresponding section, will be at one end of the handle.

It is of course possible that the wrench handles used may come with dual attachment means, one at each end of the handles. This is so that the handle can be used as a double ended handle if, for instance, one has two heads that are used greatly. That way they can always be close at hand.

The handles themselves would come as a set with the plurality of wrench heads. If one type of attachment means is favored, then of course, all of the heads and handles should use that same type of attachment means.

I claim:

1. A two piece wrench handle and adapter piece for joining to one another in order to provide for the attachment of multiple wrench heads to said adapter piece and for placing said wrench head in a plurality of positions at an angle to said adapter comprising:

a first handle piece having a front and rear, a shank portion of square cross section in connection with said front and having a front face and four side walls, said shank portion having a means for providing resilient extensions from two of said side walls that are opposite one another;

a first adapter piece having front and rear ends and a middle portion between said ends, said rear end having a four sided cavity adapted to fit around said shank portion, two of said side walls opposite one another having curved wall portions so as to be adapted to fit said resilient extensions, said front end having two projecting portions and a space between them so that said wrench head may be pivotally connected to said front end by a pin placed through said projecting portions and said wrench head, said middle portion having a threaded aperture in connection with said cavity and said space between said projecting portions, so that a set screw may be placed in said threaded aperture in order to secure said wrench head at an angle to said adapter piece.

2. The apparatus of claim 1 wherein said means for providing resilient extensions from said side walls comprises a hollow cavity in said shank portion, said cavity in connection with said front face and two of said shank walls that are opposite one another so that a resilient spring may be placed in said cavity so as to protrude from said shank walls opposite one another.

3. The apparatus of claim 2 having a second adapter piece in connection with said wrench head and said first adapter piece said second adapter piece comprising a rear portion having an aperture so that said second adapter piece may be placed within said space between said projections and pivotally connected to said adapter portion by means of a pin placed through said aperture, said second adapter piece having a means for joining to said wrench head.

* * * * *